US008408751B2

(12) United States Patent
Chen

(10) Patent No.: US 8,408,751 B2
(45) Date of Patent: Apr. 2, 2013

(54) LIGHT EMITTING DEVICE WITH CONCAVE REFLECTOR SURFACES

(75) Inventor: Pin-Chun Chen, New Taipei (TW)

(73) Assignee: Edison Opto Corporation, New Taipei (TW)

( * ) Notice: Subject to any disclaimer, the term of this patent is extended or adjusted under 35 U.S.C. 154(b) by 165 days.

(21) Appl. No.: 13/032,658

(22) Filed: Feb. 23, 2011

(65) Prior Publication Data

US 2012/0212956 A1 Aug. 23, 2012

(51) Int. Cl.
*F21V 7/09* (2006.01)

(52) U.S. Cl. ..... 362/297; 362/217.05; 362/217.07; 362/241; 362/247

(58) Field of Classification Search ..... 362/612, 362/613, 544, 545, 217.05, 217.06, 236, 362/241, 247, 249.02, 297
See application file for complete search history.

(56) References Cited

U.S. PATENT DOCUMENTS

| | | | | |
|---|---|---|---|---|
| 5,054,885 | A * | 10/1991 | Melby | 359/618 |
| 5,136,483 | A * | 8/1992 | Schoniger et al. | 362/545 |
| 5,365,411 | A * | 11/1994 | Rycroft et al. | 362/20 |
| 5,590,945 | A * | 1/1997 | Simms | 362/623 |
| 7,018,085 | B2 * | 3/2006 | Lee et al. | 362/610 |
| 7,350,951 | B2 * | 4/2008 | Sakai et al. | 362/555 |
| 7,473,019 | B2 * | 1/2009 | Laski | 362/612 |
| 7,963,689 | B2 * | 6/2011 | Lee | 362/624 |
| 8,054,407 | B2 * | 11/2011 | Imojo et al. | 349/67 |
| 8,235,540 | B2 * | 8/2012 | Park et al. | 362/97.1 |
| 2004/0114342 | A1 * | 6/2004 | Lin et al. | 362/31 |
| 2006/0256578 | A1 * | 11/2006 | Yang et al. | 362/609 |
| 2007/0171676 | A1 * | 7/2007 | Chang | 362/613 |

* cited by examiner

*Primary Examiner* — Ismael Negron
(74) *Attorney, Agent, or Firm* — CKC & Partners Co., Ltd.

(57) ABSTRACT

A light emitting device includes a light reflector and a first light source. The light reflector includes a first concave surface and a second concave surface immediately adjacent to the first concave surface. The convex ridge is located between the first and second concave surface and has an apex line extending along a direction. The first light source is located at a side of the first concave surface and opposite to the convex ridge. The first light source has a first emitting surface facing the convex ridge. The convex ridge has an apex located higher than a bottom of the first emitting surface, but lower than a top of the first emitting surface.

9 Claims, 3 Drawing Sheets

LIGHT EMITTING DEVICE WITH CONCAVE REFLECTOR SURFACES

BACKGROUND

1. Field of Invention

The present invention relates to a light emitting device.

2. Description of Related Art

As the technology advances, lower power and high-efficiency light emitting devices are more desired by modern persons. Therefore, LED (light emitting diode) lamps would gradually replace the conventional light emitting devices.

The LED is a semiconductor device, which is equipped with several advantages, such as high-efficiency, rapid response time and mercury-free. Besides, LED is also equipped with advantages of small volume, enduring higher mechanical impact and broad color gamut. As the white LED technology has been well developed, various LED applications on general illumination purpose are being performed and the LED seems the promising illumination device in the $21^{st}$ century.

However, a conventional LED lamp is only equipped with an emitting angle range of about 120 degrees, i.e. 60 degrees left or right from a normal line of an emitting surface. Compared with a conventional non-LED lamp, the emitting angle range of the LED lamp seems narrower, thereby preventing the LED lamp from broadly uses on general illumination purpose.

SUMMARY

It is therefore an objective of the present invention to provide a light emitting device with better illumination uniformity and emitting angle.

In accordance with the foregoing and other objectives of the present invention, a light emitting device includes a light reflector and a first light source. The light reflector includes a first concave surface and a second concave surface immediately adjacent to the first concave surface. The convex ridge is located between the first and second concave surface and has an apex line extending along a direction. The first light source is located at a side of the first concave surface and opposite to the convex ridge. The first light source has a first emitting surface facing the convex ridge. The convex ridge has an apex located higher than a bottom of the first emitting surface, but lower than a top of the first emitting surface.

According to an embodiment disclosed herein, the first emitting surface has a height. The apex of the convex ridge is higher than one third of the height, but lower than two third of the height.

According to another embodiment disclosed herein, the first concave surface has an opening width and the first emitting surface has a height, the opening width is about 2.8 times to about 5.8 times of the height.

According to another embodiment disclosed herein, the first emitting surface is located at a peripheral edge of the first concave surface.

According to another embodiment disclosed herein, the first concave surface has a parabola from a cross-sectional viewpoint, the parabola extends downward from the peripheral edge to form a parabolic surface.

According to another embodiment disclosed herein, the parabola has a vertex connected to the first emitting surface, and the parabola has a focal distance that is about 0.3 times to about 0.6 times of the opening width.

According to another embodiment disclosed herein, the first concave surface has a plurality of tooth members located lower than the bottom of the first emitting surface.

According to another embodiment disclosed herein, each tooth member has respective apex line in substantial parallel with the apex line of the convex ridge.

According to another embodiment disclosed herein, each tooth member is connected with an adjacent tooth member so as to form a wavy surface on the first concave surface.

According to another embodiment disclosed herein, the light emitting device further includes a second light source that is disposed at a side of the second concave surface and opposite to the convex ridge, wherein the second light source has a second emitting surface facing the convex ridge.

According to another embodiment disclosed herein, the apex of the convex ridge has an included angle ranging from about 100 degrees to about 140 degrees from a cross-sectional viewpoint.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
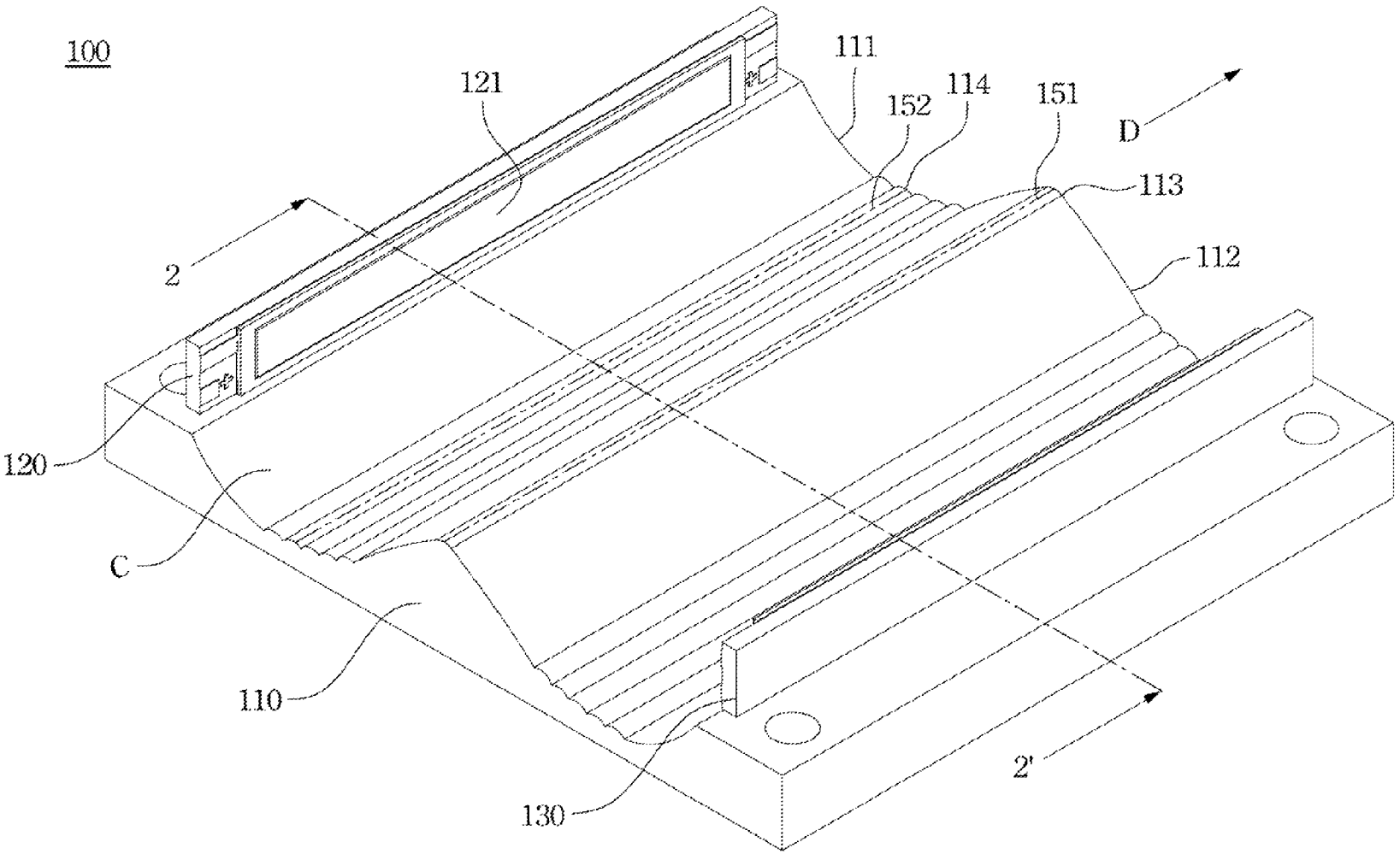
FIG. 1 illustrates a perspective view of a light emitting device according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
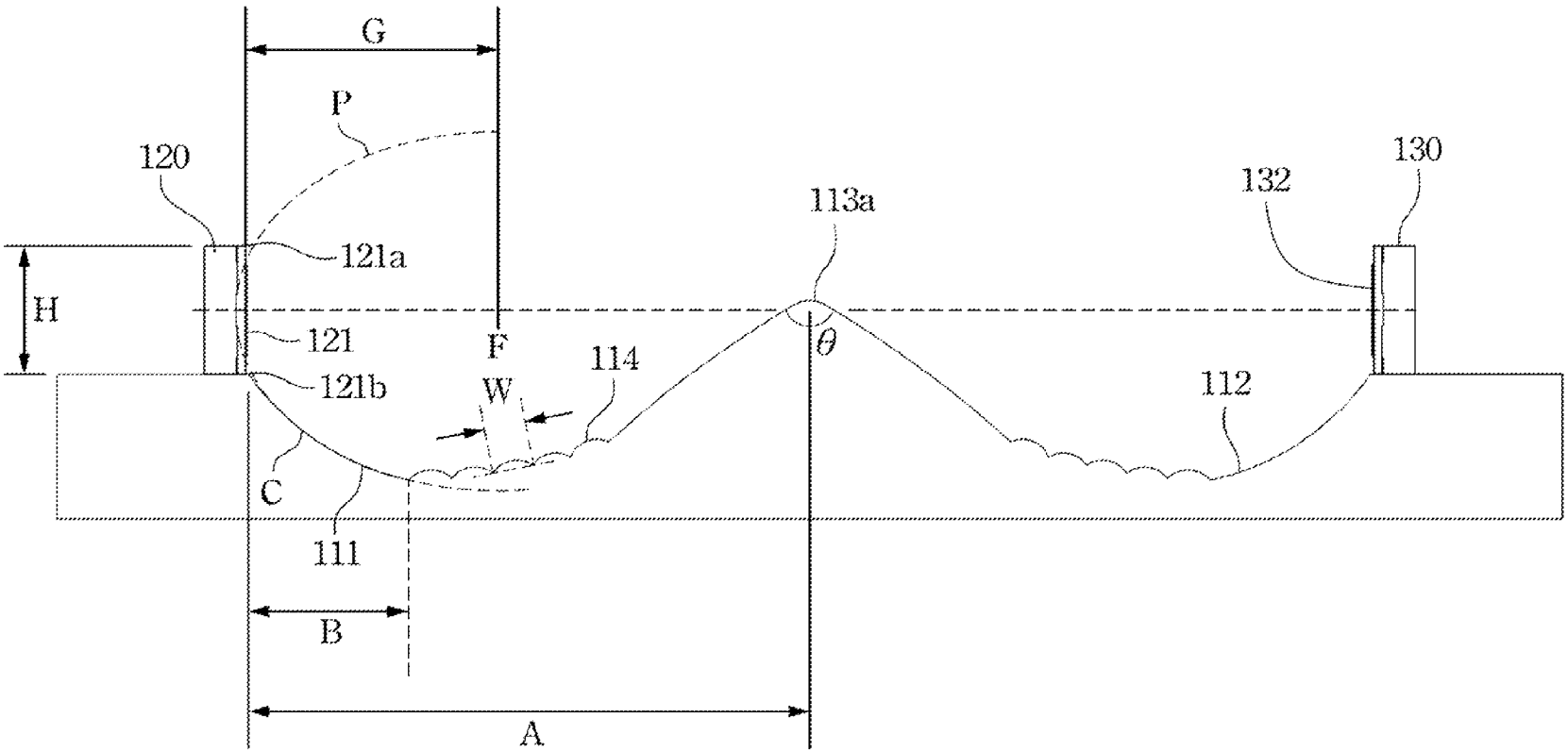
FIG. 2 illustrates a cross-sectional view taken from a cross-sectional line 2-2' in FIG. 1.

FIG. 1 illustrates a perspective view of a light emitting device 100 according to one preferred embodiment of this invention. FIG. 2 illustrates a cross-sectional view taken from a cross-sectional line 2-2' in FIG. 1. As illustrated in FIG. 1, the light emitting device 100 includes a light reflector 110 and a first light source 120.

The light reflector 110 includes a first concave surface 111 and a second concave surface 112, and the first concave surface 111 is immediately adjacent to the second concave surface 112. A convex ridge 113 is formed between the first concave surface 111 and the second concave surface 112. The apex line 151 of the convex ridge 113 generally extends along a direction D. In an embodiment, the second concave surface 112 and the first concave surface 111 are mirror symmetric to each other. The light reflector 110 is to reflect the light beams generated by the first light source 120. The light reflector 110 can be a hollow case or a solid structure. In an embodiment, the light reflector 110 is a case made from plastic materials, and its first concave surface 111 and second concave surface 112 are coated with reflective layer, such as sliver or aluminum layers, for reflecting the light beams. In an alternate embodiment, the light reflector 110 is a solid structure made of aluminum or other proper materials.

Referring to both FIG. 1 and FIG. 2, the first light source 120 is located at a side of the first concave Surface 111, and opposite to the convex ridge 113. The first light source 120 has a first emitting surface 121, which faces the convex ridge 113. The first light source 120 can be, for example, an LED lamp or other illumination devices. In an embodiment, the first emitting surface 121 is generally in parallel with an apex line 151 of the convex ridge 113, e.g. along a direction D. The convex ridge 113 has an apex 113*a*, which is higher than a bottom 121*b* of the first emitting surface 121, but lower than a top 121*a* of the first emitting surface 121 (as illustrated in FIG. 2).

In an embodiment, the light emitting device 100 can be equipped with a second in light source 130, which is located at a side of the second concave surface 112, and opposite to the convex ridge 113. The second light source 130 includes a second emitting surface 132, which faces the convex ridge 113. In an embodiment, the second light source 130 is generally in parallel with the first light source 120, and the first emitting surface 121 is opposite to the second emitting surface 132. In the disclosure herein, the second light source 130 is not an essential element, which can be replaced by a reflector.

In the light emitting device 100, which is equipped with first and second light sources (120, 130), the first light source 120 and second light source 130 can be of the same or different types of light sources. For example, the first light source 120 and second light source 130 can be light sources of two different colors and emit light beams to be mixed by the light reflector 110.

The first light source 120 emits light beams toward the convex ridge 113. The apex 113*a* of the convex ridge 113 is lower than the top 121*a* of the first emitting surface 121 such that part of the light beams go beyond the top 121*a* of the first emitting surface 121, the remaining part of the light beams are reflected and directed upwards by the first concave surface 111, which is located at a left side of the convex ridge 113. Therefore, the light emitting device 100 is capable of emitting lights along multiple directions. The height of the convex ridge 113 is a key factor for the percentage of the light beams to be transmitted upwards such that the height can be designed according to actual demands to achieve a light emitting device with better illumination uniformity and emitting angle.

In an embodiment, the apex 113*a* of the convex ridge 113 is higher than one third of the height H of the first emitting surface 121, but lower than two third of the height the height H of the first emitting surface 121. For example, the apex 113*a* of the convex ridge 113 is about a half of the height H of the first emitting surface 121. In another embodiment, the apex 113*a* of the convex ridge 113 has an included angle θ ranging from about 100 degrees to about 140 degrees from a cross-sectional viewpoint. In still another embodiment, the apex 113*a* of the convex ridge 113 has an included angle θ ranging from about 115 degrees to about 135 degrees from a cross-sectional viewpoint.

The first concave surface 111, second concave surface 112 and convex ridge 113 are utilized to direct the light beams emitted from the first light source 120 and/or second light source 130 towards a broader range of directions. In various embodiments disclosed herein, the first concave surface 111, second concave surface 112 and convex ridge 113 are carefully shaped, dimensioned and located relative to the first light source 120 so as to achieve a light emitting device with better illumination uniformity and broader emitting angle.

In the disclosure herein, an open width A denotes a horizontal interval between the apex 113*a* and an peripheral edge of first concave surface 111, at which the first light source 120 is located (as illustrated in FIG. 2). In an embodiment, the open width A is about 2.8 times to about 5.8 times of the height H of the first emitting surface 121, e.g. threefold, fourfold or fivefold.

A ratio of the open width A to the height H is a key factor for the illumination uniformity of the light emitting device 100. If this ratio is not proper, the light emitting device 100 may emit fewer light beams at a first angle and more light beams at a second angle. When the open width A is about 2.8 times to about 5.8 times of the height H of the first emitting surface 121, the light emitting device 100 can emit uniform light beams at all angles. However, the ratio of "the open width A to the height H" is not limited to 2.8-5.8 when a light emitting device emitting more light beams at a certain angle is desired.

The first concave surface 111 is specially designed to enhance the illumination uniformity of the light emitting device 100 at all emitting angles and effectively employ the emitting light beams of the first light source 120. For example, using an LED tight bar as the first light source 120, the first concave surface 111 is able to direct the light beams emitted from the lower half of the first emitting surface 121 such that the light emitting device 100 can emit light beams uniformly at all directions, which is better than a conventional LED device only emitting light within an angle rage of about 120 degrees. If the light reflector 110 is only equipped with the convex ridge 113 but without the first concave surface 111, the illumination uniformity of the light emitting device 100 would not be enhanced too much.

In an embodiment, the first concave surface 111 has a parabola P from a cross-sectional viewpoint and the first emitting surface 121 is located at a peripheral edge of the first concave surface 111. In particular, the parabola P extends downward from the peripheral edge of the first concave surface 111 to form a parabolic surface C as illustrated in FIG. 1 and FIG. 2. In an embodiment, a vertex of the parabola P is at a left side of the first emitting surface 121 and the parabola P pass by the bottom 121*b* of the first emitting surface 121 (as illustrated in FIG. 2). In another embodiment, the vertex of the parabola P is connected to the first emitting surface 121, and a focal distance G of the parabola P is about 0.3 times to about 0.6 times of the opening width A, e.g. 0.35, 0.4, 0.45, 0.5 or 0.55 times. The focal distance G denotes an interval between the vertex of the parabola P and the focal point F. The vertex of the parabola P is not necessarily at a middle point of the first emitting surface 121 and can be at an upper half or lower half of the first emitting surface 121. Besides, the axis of the parabola P is not necessarily a horizontal line, namely, the vertex of the parabola P and the focal point F can be located at different heights. The parabolic surface C is to enhance the illumination uniformity of the light emitting device 100 at all emitting angles.

In an embodiment, the first concave surface 111 has a plurality of tooth members 114 to diffuse the light beams. In another embodiment, the tooth member 114 is generally arranged along the direction D. That is, each tooth member 114 has an apex line 152, which is substantially in parallel with the apex line 151 of the convex ridge 113. The tooth member 114 has a bottom width W ranging from about 1 mm to about 2 mm, and a height (or thickness) of the tooth member 114 is about one fourth to about three fourth of its bottom width W. Tooth members 114 may have respective various dimensions and shapes, e.g. two tooth members with different heights can be alternately arranged. In another embodiment, the tooth members 114 are located on the first concave surface 111 and under the bottom 121*b* of the first emitting surface 121.

In still another embodiment, each tooth member 114 is connected with an adjacent tooth member 114 so as to form a wavy surface on the first concave surface 111. The wavy surface is connected with the parabolic surface C and the interval B is about 0.2 times to 0.4 times of the opening width A. These tooth members 114 are to diffuse the light beams so as to improve the illumination uniformity of the first concave surface 111. In another embodiment, the parabolic surface C and the wavy surface are interconnected at a lowest point of the first concave surface 111.

Generally, an LED light bar is equipped with a light emitting surface, but it emits as if it is a linear light source. According to the embodiments disclosed herein, the light emitting device is able to transform the linear light source of the LED light bar into a planar light source. According to the embodiments disclosed herein, the light emitting device is equipped with both the convex ridge and concave surface so as to achieve an excellent emitting angle range and illumination uniformity.

Figure 3:
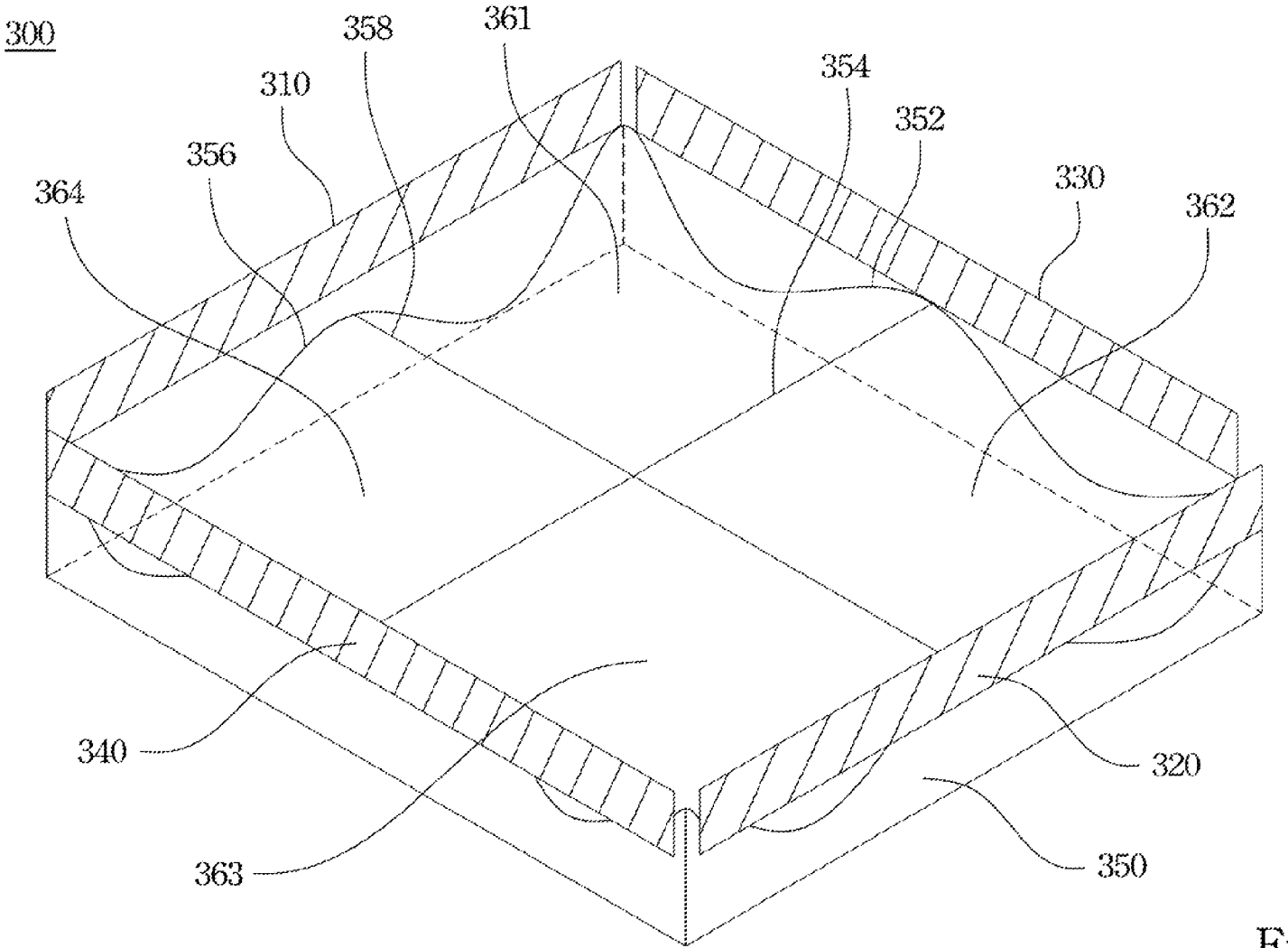
FIG. 3 illustrates a perspective view of a light emitting device according to another preferred embodiment of this invention.

FIG. 3 illustrates a perspective view of a light emitting device 300 according to another preferred embodiment of this invention. The light emitting device 300 includes a first light source 310, a second light source 320, a third light source 330, a fourth light source 340 and a light reflector 350.

In this embodiment, the light reflector 350 includes a first convex ridge 352 and a second convex ridge 356. The first apex line 354 of the first convex ridge 352 is substantially perpendicular to the second apex line 358 of the second convex ridge 356 so as to form four concave surfaces (a first concave surface 361, a second concave surface 362, a third concave surface 363 and a fourth concave surface 364) on the light reflector 350. The first, second, third and fourth concave surfaces are to reflect the light beams emitted from the first, second, third and fourth light sources (310, 320, 330, 340) respectively.

As illustrated in FIG. 3, the first, second, third and fourth light sources (310, 320, 330, 340) are located at four sides of the light reflector 350 and emit light toward the light reflector 350. The first light source 310 and second light source 320 are substantially in parallel with the first apex line 354, and the third light source 330 and fourth light source 340 are substantially in parallel with the first apex line 358.

The first light source 310 and second light source 320 are symmetric to each other with reference to the first convex ridge 352, and their locations and dimensions are similar to the embodiments as illustrated in FIG. 2. In particular, an apex of the first convex ridge 352 is higher than the bottom of the first light source 310 and second light source 320, but lower than the top of the first light source 310 and second light source 320.

Similarly, the third light source 330, fourth light source 340 are symmetric to each other with reference to the first convex ridge 356, and their locations and dimensions are similar to the embodiments as illustrated in FIG. 2. In particular, an apex of the first convex ridge 356 is higher than a bottom of the third light source 330 and fourth light source 340, but lower than a top of the third light source 330 and fourth light source 340.

Besides, the first concave surface 361, second concave surface 362, third concave surface 363 and fourth concave surface 364 are equipped with features and dimensions similar to the embodiments as illustrated in FIG. 2. In particular, the first concave surface 361, second concave surface 362, third concave surface 363 and fourth concave surface 364 are equipped with tooth members (not illustrated in the drawings) and a parabola from a cross-sectional viewpoint.

In this embodiment, the first, second, third and fourth light sources (310, 320, 330, 340) can be of the same color or different color light sources. For example, the first, second, third and fourth light sources (310, 320, 330, 340) can be light sources of two different colors and emit light beams to be mixed by the light reflector 350.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light emitting device comprising:

a light reflector comprising a first concave surface and a second concave surface immediately adjacent to the first concave surface, a convex ridge being disposed between the first and second concave surface and having an apex line extending along a direction; and a first light source being disposed at a side of the first concave surface and opposite to the convex ridge, wherein the first light source has a first emitting surface facing the convex ridge, and the apex line is disposed farther from a bottom surface of the light reflector than a bottom of the first emitting surface, but closer to the bottom surface of the light reflector than a top of the first emitting surface, wherein the first concave surface has an opening width and the first light emitting surface has a height, the opening width is about 2.8 times to about 5.8 times of the height.

2. The light emitting device of claim 1, further comprising a second light source that is disposed at a side of the second concave surface and opposite to the convex ridge, wherein the second light source has a second emitting surface facing the convex ridge.

3. The light emitting device of claim 1, wherein the apex of the convex ridge has an included angle ranging from about 100 degrees to about 140 degrees from a cross-sectional viewpoint.

4. The light emitting device of claim 1, wherein the first emitting surface is located at a peripheral edge of the first concave surface.

5. The light emitting device of claim 4, wherein the first concave surface has a parabola from a cross-sectional viewpoint, the parabola extends downward from the peripheral edge to form a parabolic surface.

6. The light emitting device of claim 5, wherein the parabola has a vertex connected to the first emitting surface, and the parabola has a focal distance that is about 0.3 times to about 0.6 times of the opening width.

7. The light emitting device of claim 1, wherein the first concave surface has a plurality of tooth members disposed closer to the bottom surface of the light reflector than the bottom of the first emitting surface.

8. The light emitting device of claim 7, wherein each tooth member has respective apex line in substantial parallel with the apex line of the convex ridge.

9. The light emitting device of claim 8, wherein each tooth member is connected with an adjacent tooth member so as to form a wavy surface on the first concave surface.

* * * * *